United States Patent [19]

Mordue

[11] Patent Number: 4,739,974

[45] Date of Patent: Apr. 26, 1988

[54] MOBILE HOLDING FURNACE HAVING METERING PUMP

[75] Inventor: George S. Mordue, Shalersville, Ohio

[73] Assignee: Stemcor Corporation, Cleveland, Ohio

[21] Appl. No.: 938,367

[22] Filed: Dec. 4, 1986

Related U.S. Application Data

[63] Continuation of Ser. No. 779,163, Sep. 23, 1985, abandoned.

[51] Int. Cl.[4] ..... C22B 9/16; C21C 7/00

[52] U.S. Cl. ..... 266/165; 266/236; 266/242

[58] Field of Search ..... 266/165, 242, 236, 227; 222/591, 596, 593, 597

[56] References Cited

U.S. PATENT DOCUMENTS

| | | | |
|---|---|---|---|
| 1,488,436 | 3/1924 | Pugh | 266/165 |
| 2,322,787 | 6/1943 | Brennan | 266/242 |
| 2,678,266 | 5/1954 | Zifferer | 266/242 |
| 3,663,730 | 5/1972 | Gates | 222/591 |
| 3,718,265 | 2/1973 | Trost | 266/165 |
| 4,444,377 | 4/1984 | Groteke et al. | 266/227 |
| 4,474,315 | 10/1984 | Gilbert et al. | 222/591 |

*Primary Examiner*—L. Dewayne Rutledge
*Assistant Examiner*—S. Kastler
*Attorney, Agent, or Firm*—Wayne D. Porter, Jr.; R. Lawrence Sahr

[57] ABSTRACT

A mobile holding furnace having a metering pump is adapted to hold a relatively small quantity of molten metal in a contamination-free condition for dispensing to individual molds. The furnace is provided with insulation and electric heating elements for maintaining the molten metal in a liquid state. The furnace is sealed such that an atmosphere of inert gas can be maintained above the level of molten metal. The furnace is mounted upon wheels for easy transportation from place to place. The furnace is used in conjunction with tracks disposed adjacent individual molds, the tracks permitting the furnace to be locked in place while molten metal is dispensed into the molds.

17 Claims, 2 Drawing Sheets

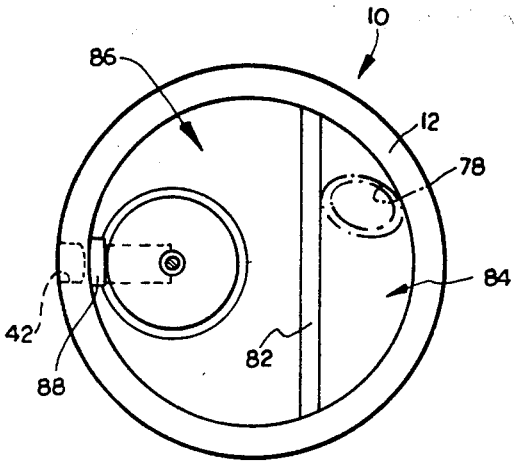
FIG.3
FIG.4
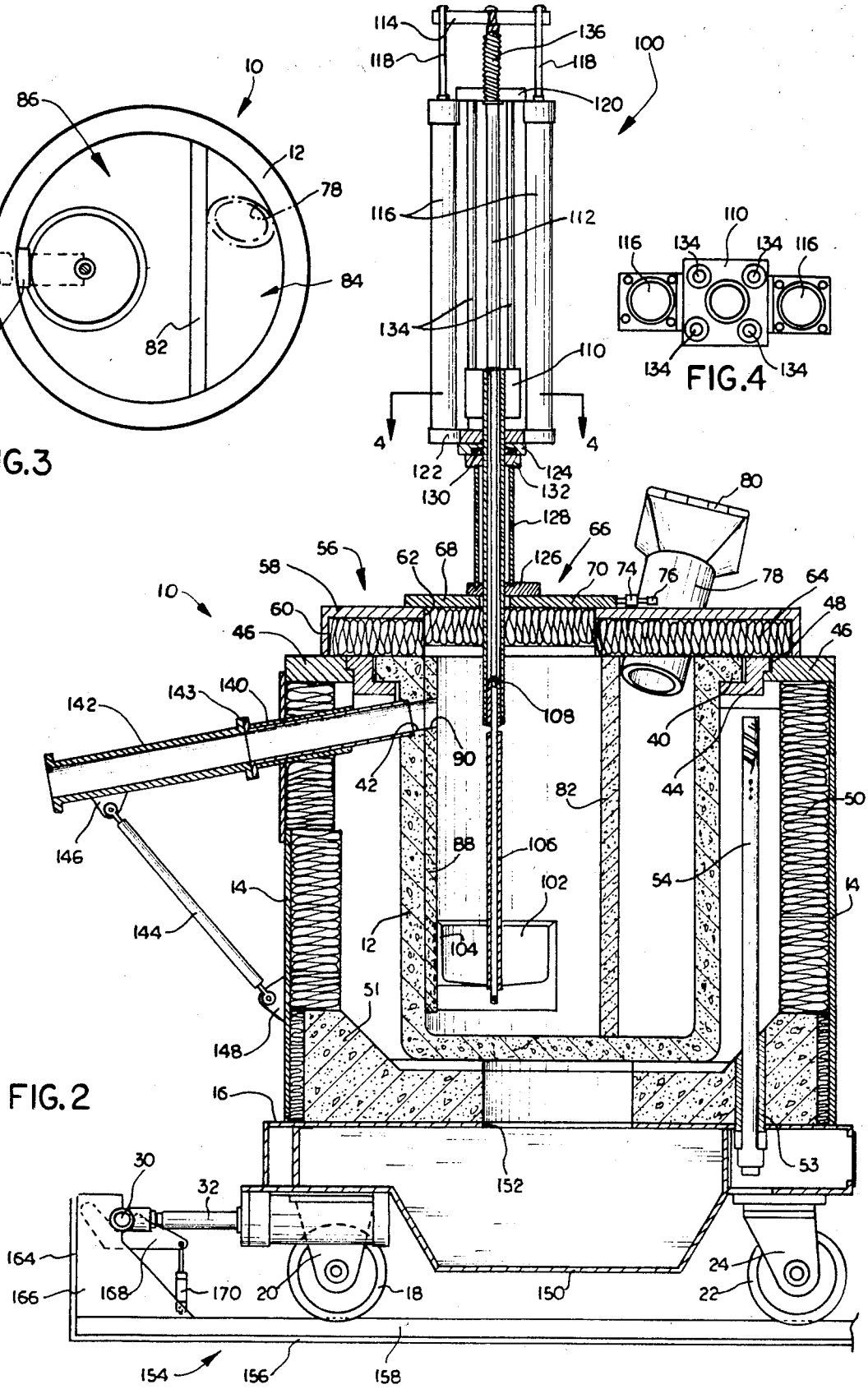
FIG. 2

MOBILE HOLDING FURNACE HAVING METERING PUMP

This application is a continuation of U.S. application Ser. No. 779,163, filed on 09/23/85, now abandoned.

BACKGROUND OF THE INVENTION

1. Field of the Invention

The invention relates to the delivery of molten metal for casting purposes and, more particularly, to a mobile holding furnace having a metering pump capable of dispensing contamination-free molten metal in discrete quantities.

2. Description of the Prior Art

Various techniques are known for dispensing molten metal for casting purposes in a foundry. Crane-carried ladles have been used for many years to transfer molten metal from a furnace or holding tank to individual molds. So-called metering pumps have been used to transfer molten metal in discrete quantities from a furnace or holding tank to a gating system which, in turn, conveys the metal to individual molds. U.S. Pat. No. 4,078,706 to S. Hanuszczak and U.S. Pat. No. 4,474,315 to R. E. Gilbert et al, the disclosures of which are incorporated herein by reference, disclose metering pumps suitable for dispensing molten metal from a furnace or holding tank to individual molds.

The chief drawback of the referenced molten metal transfer techniques is that molten metal is susceptible to being oxidized and/or contaminated during passage of the molten metal from the furnace or the holding tank to the molds. In part, this is because the ladles and gating systems are exposed to the atmosphere. If the highest quality castings are desired, the presence of oxidation or contaminants is unacceptable.

One possible approach to solving the problem would be to provide mobile molds which could be moved very close to the furnace or holding tank. Another possible approach would be to shield the ladles or gating system with a controlled, inert atmosphere. Unfortunately, both of these possible approaches would present additional problems not existing presently. It would be very difficult and expensive to modify existing foundries to permit individual molds to be moved close to the furnaces or holding tanks. It also would be difficult and expensive to modify existing molten metal transfer equipment to provide a controlled, inert atmosphere all the way from the furnaces or holding tanks to the molds.

SUMMARY OF THE INVENTION

In response to the foregoing and other considerations, the present invention provides a new and improved technique for transferring molten metal from a furnace or holding tank to individual molds. The invention includes a small, mobile holding furnace which is filled with filtered molten metal and which is moved from mold to mold by conventional foundry equipment such as a tow truck. The furnace includes a container for holding the molten metal, and means for maintaining the molten metal in a liquid state while in the container. The means for maintaining the molten metal in a liquid state preferably includes an insulated housing within which the container is disposed, and electrically operated heaters disposed within the housing and about the container.

In order to keep the molten metal free of oxidation and contaminants, the furnace includes a means for controlling the chemical content of the atmosphere above the molten metal. The means for controlling the chemical content of the atmosphere includes a cover for the top of the container, the cover rendering the container relatively airtight, and an inert gas such as argon or nitrogen disposed above the level of the molten metal in the container. In the preferred embodiment, the outlet is provided with a closure for reducing the flow of inert gas through the outlet.

Although different metering pumps can be used with the invention, a preferred metering pump is like that disclosed in U.S. Pat. No. 4,474,315 to R. E. Gilbert et al (hereafter referred to as the '315 patent). A planar, generally vertically oriented surface extends from near the bottom of the container to the outlet. The pump includes a cup-like bucket having a generally vertically oriented slot along one side, the edges of the slot being in contact with the planar surface. The invention further includes means for biasing the bucket against the planar surface, and means for reciprocating the bucket vertically along the planar surface. In order to reduce the possibility that oxidation or contaminants will be pumped from the container, a filter is disposed within the container to divide the container into two chambers. The two chambers are in fluid communication with each other through the filter. Molten metal is introduced into the first chamber from a furnace or holding tank. The pump and the outlet are disposed in the second chamber.

The furnace includes a frame atop which the container is disposed, the frame including wheels on its underside and a means for engaging the frame to move it from place to place. The invention further includes spaced tracks adapted to receive the wheels, individual sets of spaced tracks being disposed adjacent individual molds in the foundry. A latch is connected to the tracks, the latch being engageable with the frame to secure the frame in a stationary position relative to the tracks. An extensible connection is disposed intermediate the latch and the frame, the extensible connection permitting the frame to be moved short distances relative to the tracks. In the preferred embodiment, the extensible connection includes a bumper engageable with the latch and fluid-operated cylinders connected at one end to the bumper and connected at the other end to the frame.

The invention also includes a reservoir secured to the underside of the frame. The reservoir is adapted to receive molten metal discharged from the container upon inadvertent rupture of the container. These, and other features and advantages of the invention, are disclosed in more detail in the accompanying description and claims, taken in conjunction with the accompanying drawings.

BRIEF DESCRIPTION OF THE DRAWINGS

FIG. 2 is a cross-sectional view of the holding furnace of FIG. 1, showing additional details of construction and certain modifications;

FIG. 3 is a schematic top plan view of the holding furnace of FIG. 2; and

FIG. 4 is a cross-sectional view of a portion of a metering pump used with the invention taken along a plane indicated by line 4—4 in FIG. 2.

DESCRIPTION OF THE PREFERRED EMBODIMENT

Figure 1:
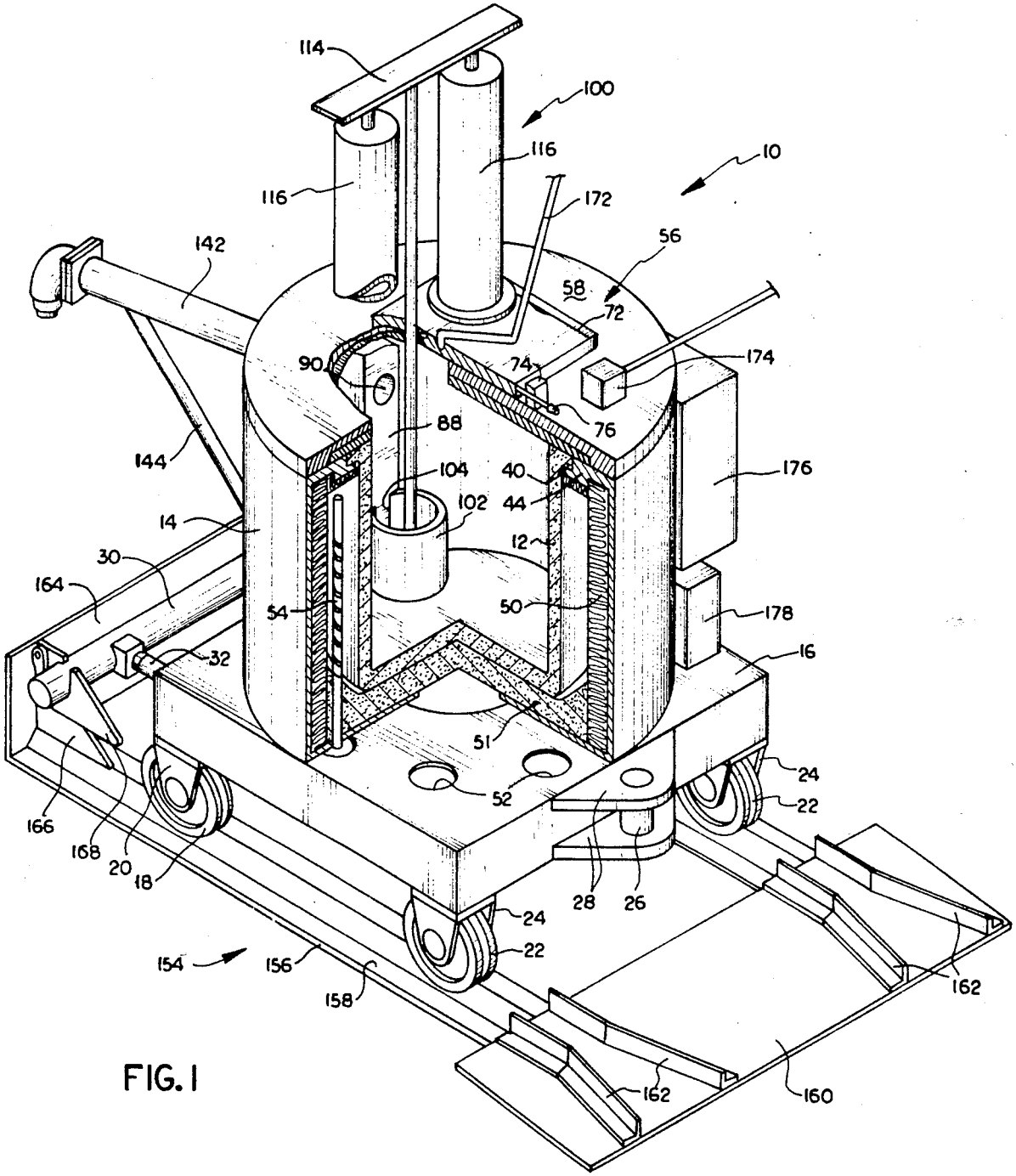
FIG. 1 is a perspective view of a mobile holding furnace according to the invention, with portions of the furnace being broken away and removed for clarity of illustration.

Referring to FIGS. 1-3, a mobile holding furnace according to the invention is indicated generally by the reference numeral 10. The furnace 10 is well-suited for use with molten aluminum, but it can be used with other molten metals, if desired.

The furnace 10 includes a cylindrical container 12 made of graphite or other temperature-resistant material. The container 12 is disposed within a housing 14 supported atop a frame 16. The frame 16 is provided with a pair of front wheels 18 supported by rigid casters 20. The frame also includes a pair of rear wheels 22 supported by swivel casters 24. The wheels 18, 22 are made of metal, are approximately 8 inches in diameter, and can support approximately 2500 pounds apiece. Referring particularly to FIG. 1, a vertically oriented pin 26 is connected to the frame 16 by means of horizontally disposed brackets 28. The pin 26 is centered between the rear wheels 22. The pin 26 provides a means by which lateral force can be applied to the frame 16 in order to move the furnace 10 from place to place within the foundry. It is expected that conventional foundry equipment such as a tow truck will be used for this purpose.

A horizontally disposed bumper 30 is spaced a short distance forwardly of the front wheels 18. The bumper 30 is connected to the frame 16 by means of extensible, pneumatically actuated cylinders 32. In FIG. 1, the cylinders 32 are shown in their retracted position, and in FIG. 2, the cylinders 32 are shown in their extended position.

The container 12 includes a lateral, circumferentially extending lip 40. An outlet opening 42 is provided in the side wall of the container 12 adjacent the top of the container 12, beneath the lip 40. A steel ring 44 encircles the container 12 and is in engagement with the underside of the lip 40. The ring 44 includes a plurality of threaded openings (not shown). Threaded eyelets can be inserted into the openings in order to facilitate lifting of the container 12 for removal from the housing 14.

A circumferential, inwardly extending ledge 46 is disposed at the top of the housing 14. The ledge 46 includes a rabbeted edge 48 adapted to support the ring 44. A plurality of insulation modules 50 are fitted inside the housing 14, surrounding the container 12, in order to insulate the container 12. A relatively heavy, dense refractory material 51 such as that sold under the trademark PLIBRICO is disposed within the housing 14 atop the frame 16. The refractory material 51 lowers the center of gravity of the furnace 10 in order to prevent the furnace 10 from being toppled over. The refractory material 51 also assists in insulating the container 12.

Referring particularly to FIG. 1, the frame 16 includes a plurality of openings 52. Electrically actuated, bayonet-type heaters 54 extend through the openings 52 and into the space between the container 12 and the insulation modules 50. The heaters 54 also extend through suitable spacers 53 fitted into openings in the refractory material 51.

The furnace 10 includes a cover 56 for rendering the container 12 relatively airtight. The cover 56 includes a horizontally extending, circular top wall 58 from which a skirt 60 depends. The skirt 60 rests atop the ledge 46. The top wall 58 includes an opening 62. Insulation panels 64 are disposed within the cover 56. A plate 66 is disposed atop the opening 62. The plate 66 includes a first, removable section 68 and a second, non-removable section 70. Spaced, parallel rails 72 are secured atop the top wall 58. The plate 66 is disposed intermediate the rails 72. A threaded lug 74 is secured to the top wall 58. A threaded fastener 76 such as a bolt or set screw is threaded through the lug 74 and into engagement with the second section 70. As will be apparent from an examination of FIGS. 1 and 2, lateral movement of the fastener 76 will cause the second section 70 to be moved back and forth between the rails 72.

In the embodiment illustrated in FIG. 2, a funnel 78 extends through an opening in the top wall 58. The funnel 78 includes a movable lid 80. A porous filter 82 is disposed within the container 12, dividing the container 12 into a first chamber 84 and a second chamber 86. The first and second chambers 84, 86 are in fluid communication with each other through the filter 82. The funnel 78 discharges into the first chamber 84, while the outlet opening 42 is in communication with the second chamber 86. If desired, the filter 82 could be made smaller and incorporated within the funnel 78. A generally vertically extending planar surface 88 is disposed in the second chamber 86 adjacent the outlet opening 42. The planar surface 88 includes an opening 90 in horizontal alignment with the opening 42. In the embodiment illustrated, the planar surface 88 is formed of a refractory material such as graphite secured to the inner surface of the container 12 by cement. The planar surface 88 extends from a location near the bottom of the container 12 to the top of the container 12. If desired, the container 12 can be manufactured to include the planar surface 88 as an integral part, rather than as an add-on part.

A pump 100 is provided for the furnace 10. The pump 100 is like that disclosed in the '315 patent. The pump 100 includes a cup-like bucket 102 having a generally vertically oriented slot 104 formed in its side wall. As can be seen in FIGS. 1 and 2, the edges of the slot 104 are adapted to be pressed against the planar surface 88.

A first shaft 106 is connected to the bucket and extends vertically upwardly. The first shaft 106 is connected to the bottom end of a second shaft 108 which is connected at it upper end to a slide 110. A third shaft 112 extends upwardly from the slide 110 and is connected at its other end to a header plate 114. A pair of hydraulically actuated cylinders 116 are connected to the header plate 114 by means of extensible piston rods 118. A first support bracket 120 is connected to the upper ends of the cylinders 116, while a second support bracket 122 is connected to the lower ends of the cylinders 116. A first collar 124 is connected to the underside of the support bracket 122. A second collar 126 is connected to the second section 70 of the plate 66 by means of bolted fasteners (not shown). A cylindrical spacer 128 is disposed intermediate the first and second collars 124, 126, and is hollow to receive the second shaft 108. A graphite packing 130 is disposed within the first collar 124 so as to provide a gas-tight seal against the outer surface of the second shaft 108. A circumferentially extending hub 132 is disposed about the second shaft 108 and presses against the packing 130. Referring particularly to FIG. 4, four rods 134 extend between the support brackets 120, 122. The slide 110 includes four openings through which the rods 134 extend and which permit the slide 110 to be reciprocated vertically along the length of the rods 134.

A vertically oriented threaded stop 136 surrounds the third shaft 112 and, in turn, is threaded through an opening in the support bracket 120. As will be apparent from an examination of FIG. 2, vertical adjustment of the stop 136 will control the vertical displacement of the slide 110. Because the bucket 102 is connected to the slide 110 by way of the shafts 106, 108, vertical displacement of the bucket 102 can be controlled in this manner. The vertical position of the threaded stop 136 can be adjusted by means of a remotely controlled gear motor, or it can be adjusted by hand.

A first outlet pipe 140 extends through the housing 14 and into the opening 42. A second outlet pipe 142 is connected to the first outlet pipe by means of a flanged connection 143. A brace 144 is provided to support the second pipe 142. The brace is connected to the pipe 142 and the housing 14 by means of flanges 146, 148, respectively.

A reservoir 150 is disposed beneath the frame 16 intermediate the wheels 18, 22. An opening 152 is provided in the center of the frame 16 directly beneath the container 12. In the event the container 12 inadvertently should rupture, molten metal will flow downwardly into the reservoir 150, and not onto the floor. The reservoir 150 is spaced radially inwardly from the openings 52 in order to prevent molten metal from damaging the heaters 54 in the event the container 12 should rupture.

The invention includes a pair of tracks 154 adapted to be disposed adjacent a mold. In practice, it is expected that a number of pairs of tracks 154 will be provided, one pair for each mold. The tracks 154 are of a length such that the rear wheels 22 will remain on the tracks 154 upon extension of the cylinders 32 as shown in FIG. 2. Each of the tracks 154 includes a horizontally disposed plate 156 having spaced, upstanding, parallel side rails 158 adapted to receive the wheels 18, 22 therebetween. A ramp 160 connects the entrance end of the tracks 154. A pair of converging, upstanding side rails 162 are secured to the ramp 160 in order to guide the wheels 18, 22 onto the plates 156. An upstanding connecting plate 164 is connected to the other end of the plates 156. Gussets 166 are connected to the plates 156, 164 for added strength. Each of the gussets 166 carries a pivotally mounted latch 168 engageable with the bumper 30. A pneumatically actuated cylinder 170 is connected to each of the latches 168 at one end and to the lower portion of the gussets 166 at the other end. By appropriate control of the cylinders 170, the latches 168 can be locked or unlocked, as may be desired.

Referring particularly to FIG. 1, a conduit 172 extends through the opening 62 and into the container 12 above the level of molten metal that will be maintained in the container 12. A source of inert gas such as argon or nitrogen is connected to the other end of the conduit 172 for purposes of supplying so-called shield gas to the container 12. A thermocouple junction box 174 is disposed atop the top wall 58 in the vicinity of the threaded lug 74. A thermocouple (not shown) is carried by the box 174 for purposes of determining the temperature in the container 12 and providing a feedback signal to controls for the heater elements 54. A pump sequence control panel 176 is secured to the side of the housing 14. The panel 176 contains various components that control operation of the pump 100. A heater power cable junction box 178 is attached to the housing 14 at a location beneath the control panel 176. The junction box 178 enables electrical connections to be made with the heater elements 54 by way of electrical leads (not shown). The various electrical, hydraulic, and pneumatic connections employed with the furnace 10 can be made by way of flexible, extensible conduits such as are commonly found in foundrys. The use of such conduits ensures that the furnace 10 can be moved without difficulty.

Operation

The general operation of the furnace 10 in a foundry is as follows:

1. Sets of tracks 154 are positioned close to molds which are desired to be filled with filtered molten metal.
2. The pin 26 is connected to a tow truck and the furnace 10 is moved close to a furnace or holding tank containing molten metal.
3. Argon or nitrogen shield gas is pumped into the container 12 through the conduit 172.
4. Molten metal is poured into the container 12 through the funnel 78 up to a level in the region of the opening 90. The filter 82 traps any solid impurities or oxides as the molten metal flows from the first chamber 84 into the second chamber 86.
5. The lid 80 is closed after the container 12 has been filled to a desired level.
6. The end of the second outlet pipe 142 is closed by means of an obstruction such as a ceramic fiber wad in order to minimize the loss of shield gas.
7. The furnace 10 is pushed to the area where molds to be filled are located.
8. The wheels 18, 22 are pushed onto the tracks 154 until the bumper 30 engages the latch 168 and is locked in place.
9. The mold is opened.
10. The cylinders 32 are retracted in order to position the outlet pipe 142 over the mold.
11. The closure for the pipe 142 is removed.
12. The cylinders 116 are activated. The bucket 102 is raised to a predetermined position (determined by the stop 136) and molten metal is dispensed through the outlet pipes 140, 142.
13. While dispensing of molten metal is occurring, shield gas is continually pumped through the conduit 172 in order to maintain the purity of the molten metal.
14. After dispensing of molten metal has been completed, the cylinders 32 are extended in order to move the outlet pipe 142 away from the mold.
15. The mold is closed.
16. The end of the outlet pipe 142 is closed.
17. The latches 168 are released by the cylinders 170 and the furnace 10 is moved off of the tracks 154 to another set of tracks 154 adjacent another mold to be filled.
18. The first section 68 of the plate 66 can be removed without disturbing other components of the furnace 10 in order to inspect the level of molten metal remaining in the container 12.

It will be appreciated that different buckets 102 can be used with the container 12 in order to pump different quantities of molten metal with each stroke of the pump 100. In order for the bucket 102 to be removed and changed, it is necessary only to remove the first and second sections 68, 70 of the plate 66. The opening 62 in the cover 56 is large enough for the largest bucket 102 to be removed. Substitution of a bucket 102 is effected by extending the cylinders 116 to their fullest length, disconnecting the first shaft 106 from the second shaft 108, and substituting a new bucket 102 and a new first shaft 106. After the bucket 102 has been lowered and the first and second sections 68, 70 have been replaced to that position shown in FIG. 2, the threaded fastener 76 can be adjusted to cause the bucket 102 to be biased against the planar surface 88. As is explained in more detail in the '315 patent, it is necessary that the bucket 102 be biased against the planar surface 88 in order to ensure that no molten metal is lost from the bucket 102 through the slot 104 as the bucket 102 is reciprocated vertically.

As should be apparent from the foregoing description, the present invention enables molten metal to be maintained at a desired temperature and dispensed with little or no oxidation and/or contaminants being present in the material dispensed. The furnace 10 can be constructed relatively inexpensively, and it is easy to use. Sources of shield gas, electricity, compressed air, and compressed fluid are readily available in most foundries. The use of commonly available tow trucks in conjunction with the tracks 154 makes the furnace 10 adaptable to almost any foundry installation. The use of the cylinders 32 avoids any need to make the outlet pipe 142 movable relative to the molds. Additionally, the presence of the reservoir 150 is a safety and convenience factor which avoids difficulties in handling spilled molten metal.

Although the invention has been described in its preferred form with a certain degree of particularity, it will be appreciated that the various parts and their combination and arrangement can be modified within the true spirit and scope of the invention as claimed hereinafter. It is intended that the patent shall cover, by suitable expression in the appended claims, whatever degree of patentable novelty exists in the invention disclosed.

What is claimed is:

1. A mobile holding furnace, comprising:
a container for holding molten metal;
means for maintaining the molten metal in a liquid state while in the container;
an outlet in fluid communication with the container through which molten metal can be dispensed, the outlet being disposed toward the upper portion of the container;
a pump disposed at least partially within the container for dispensing discrete quantities of molten metal from the container;
a frame atop which the container is disposed;
a plurality of wheels atop which the frame is disposed, the wheels permitting the frame to be moved from place to place;
spaced tracks adapted to receive the wheels, the tracks adapted to be disposed adjacent individual molds;
a latch connected to the tracks, the latch engageable with the frame to secure the frame in a stationary position relative to the tracks; and
an extensible connection disposed intermediate the latch and the frame, the extensible connection permitting the frame to be adjusted short distances relative to the tracks.

2. The furnace of claim 1, further including:
a planar, generally vertically oriented surface extending from the bottom of the container to the outlet; and
the pump includes a cup-like bucket having a generally vertically oriented slot along one side, the edges of the slot being in contact with the planar surface, means for biasing the bucket against the planar surface, and means for reciprocating the bucket vertically along the planar surface.

3. The furnace of claim 2, wherein the planar surface is an elongate strip of refractory material cemented to the inner surface of the container.

4. The furnace of claim 2, further including:
a cover atop the container, the cover having a first opening; and
a plate removably secured to the cover, the plate covering the first opening in the cover, the plate having an opening through which the means for reciprocating the bucket extends.

5. The furnace of claim 4, wherein the means for reciprocating the bucket includes a vertically oriented shaft to which the bucket is connected.

6. The furnace of claim 5, wherein the means for biasing the bucket includes a threaded lug on the cover, and a threaded fastener extending through the lug and engageable with the plate.

7. The furnace of claim 4, further including:
a second opening in the cover; and
a funnel disposed within the second opening, the funnel having a lid for selectively opening and closing the funnel.

8. The furnace of claim 1, wherein the means for maintaining the molten metal in a liquid state includes:
a housing within which the container is disposed;
insulation disposed intermediate the container and the housing; and
electrically operated heaters disposed within the housing and about the container.

9. The furnace of claim 1, further comprising means for controlling the chemical content of the atmosphere above the molten metal, said means including:
a cover disposed atop the container, the cover rendering the container relatively airtight; and
inert gas disposed above the level of molten metal in the container.

10. The furnace of claim 9, further comprising a closure for the outlet, the closure substantially reducing the flow of inert gas through the outlet.

11. The furnace of claim 1, further including a filter disposed within the container, the filter dividing the container into first and second chambers in fluid communication with each other through the filter, molten metal being introduced into the first chamber, and the pump and the outlet being disposed in the second chamber.

12. The furnace of claim 1, further including
means for engaging the frame to apply lateral force to the frame.

13. The furnace of claim 12, wherein the means for engaging the frame is a vertically oriented pin spaced from the frame.

14. The furnace of claim 1, wherein the extensible connection includes a bumper engageable with the latch and fluid-operated cylinders connected at one end to the bumper and connected at the other end to the frame.

15. The furnace of claim 1, wherein the latch is pivotally connected to the tracks and further including a fluid-operated cylinder connected at one end to the latch and connected at the other end to the tracks.

16. A mobile holding furnace, comprising:
a container for holding molten metal;
means for maintaining the molten metal in a liquid state while in the container;

an outlet in fluid communication with the container through which molten metal can be dispensed;

dispensing means disposed at least partially within the container for dispensing discrete quantities of molten metal from the container through the outlet; and reservoir means disposed beneath the container for receiving molten metal discharged from the container upon rupture of the container.

17. A mobile holding furnace, comprising:

a container for holding molten metal;

means for maintaining the molten metal in a liquid state while in the container;

means for controlling the chemical content of the atmosphere above the molten metal in the container;

an outlet in fluid communication with the container through which molten metal can be dispensed, the outlet being disposed toward the upper portion of the container;

a pump disposed at least partially within the container for dispensing discrete quantities of molten metal from the container;

a frame atop which the container is disposed; and a reservoir secured to the underside of the frame beneath the container, the reservoir adapted to receive molten metal discharged from the container upon rupture of the container.

* * * * *